United States Patent [19]

Lohausen

[11] Patent Number: 4,784,204

[45] Date of Patent: Nov. 15, 1988

[54] AWNING

[76] Inventor: Viktor Lohausen, Goldmühlestr. 99/2, D-7032 Sindelfingen, Fed. Rep. of Germany

[21] Appl. No.: 716,198

[22] Filed: Mar. 26, 1985

[30] Foreign Application Priority Data

Mar. 29, 1984 [CH] Switzerland ..... 1587/84

[51] Int. Cl.[4] ..... E04F 10/06

[52] U.S. Cl. ..... 160/22; 160/70

[58] Field of Search ..... 160/22, 67, 68, 66, 160/70

[56] References Cited

U.S. PATENT DOCUMENTS

| | | | |
|---|---|---|---|
| 1,833,688 | 11/1931 | Nelson et al. | 160/22 |
| 2,083,726 | 6/1937 | Mason | 160/22 |
| 2,547,693 | 4/1951 | D'Azzo | 160/22 |
| 3,503,566 | 3/1970 | Travis | 160/22 |
| 4,566,516 | 1/1986 | Lohausen | 160/22 |

FOREIGN PATENT DOCUMENTS

| | | |
|---|---|---|
| 1953739 | 3/1971 | Fed. Rep. of Germany . |
| 2153676 | 5/1973 | Fed. Rep. of Germany . |
| 1683207 | 6/1978 | Fed. Rep. of Germany . |
| 2752807 | 5/1979 | Fed. Rep. of Germany . |
| 2853286 | 6/1980 | Fed. Rep. of Germany . |
| 3026309 | 2/1982 | Fed. Rep. of Germany . |
| 2752872 | 9/1982 | Fed. Rep. of Germany . |
| 3206963 | 10/1984 | Fed. Rep. of Germany . |
| 2522349 | 2/1983 | France . |

*Primary Examiner*—Ramon S. Britts
*Assistant Examiner*—David M. Purol
*Attorney, Agent, or Firm*—Ostrolenk, Faber, Gerb & Soffen

[57] ABSTRACT

An awning having a frame including a bearing arm on each side which may move between a vertical relatively flat position for the awning when the awning canopy is retracted to an extended canopy forming position for the awning when the canopy is drawn out, wherein said bearing member is further supported and positioned, especially in the extended position, by a nut which is moveable on an adjustable member to predetermine the canopy formation of the awning, which nut may also be provided with a locking device to limit or prevent movement of the bearing member from an extended position toward a flat position on the occurrence of wind gusts.

28 Claims, 9 Drawing Sheets

AWNING

BACKGROUND OF THE INVENTION

Cross-Reference to Related Application

Reference is made to my co-pending Application, Ser. No. 673.913, filed Nov. 28, 1984, now U.S. Pat. No. 4,566,516, which is part of Ser. No. 06/469.728, filed Feb. 25, 1983, now abandoned.

BRIEF DESCRIPTION OF THE INVENTION

The present invention relates to an awning construction having a support and an awning web together with an awning shaft rotably supported in a substantially horizontal position by the support. The web is arranged to unroll and is fixed with its inner end secured to the awning shaft so that the awning web may be unwound with its outer end free. Bearing support means are hinged on the support to be tiltable about a tube axis arranged substantially parallel to the awning shaft. A front bar is connected to the external end of the awning. An articulated arm having an inner end and an outer end and outer joint means pivotally interconnecting the outer end of the articulated arm and the front bar is provided. Inner joint means pivotally interconnect the inner end of the articulated arm and the bearing support.

In addition, tilt-down limiting means may be provided in accordance with the present invention to limit the tilting movement of the bearing support member when the awning web begins to be unwound. The tilt-down limiting means includes a screw bolt having a longitudinal axis and pivotally mounted on the support about a pivoting axis parallel to the tilt axis. Adjustable abutment means on the screw bolt and counter-abutment means on the bearing support means are provided. Tilt-up control means include a socket member having a peripheral wall and movable between a locking position and a releasing position.

The slot means in the peripheral wall is arranged to embrace the screw bolt means at least in the locking position on that side of the abutment means which is opposite from the counter-abutment means. A guide is provided on the bearing support for guiding the movement of the socket and drive means are connected with the articulated arm to provide a synchronized movement of the socket. The abutment comprises a lug extending substantially normal to the screw bolt means in the locking position of the socket means wherein the lug is embraced by the screw bolt means.

DESCRIPTION OF RELATED ART

In a known awning, e.g. according to the German Publication No. 28 53 286 (Loos), the locking element is guided merely in a guide arranged in the hinged bearing support at the side of the counterstop. In the locked position, with the bearing support hinged down the locking element is moved by the pivoting jointed arm, and in this condition the two arms of the fork of the locking element facing the stop, engage behind the stop on the side facing away from the counterstop. By virtue of this arrangement, and of the configuration of the wind lock, the force of wind gusts transmitted by the extended awning canopy via the jointed arms acts on the arms of the locking element. Due to the lateral guiding of the locking element said arms can bend with the result that when the awning is being rolled up it is only possible to move the locking element into the unlocked position, with the fork arms also in the guide, by the exertion of a strong force, or not at all. To render the locking element movable again the fork arms must be straightened or the locking element must be replaced, which can generally only be done by a specialist. In addition, when the awning is being rolled up with a bent locking element, i.e. one which cannot be moved back, the push and pull bar, connecting the locking element with the jointed arm, can be bent, whereby it is rendered unusable.

SUMMARY OF THE INVENTION

It is the object of the present invention to devise a tilt limiter with a wind lock for an awning of the above discussed type so that its function is no longer impaired even in case of very strong wind gusts.

This object is achieved by the present invention by the characteristics particularly as above noted.

With a tilt limiter with wind lock according to the solutions described above the attack of forces on the stop resulting from wind gusts is transmitted via the sleeve area on both sides of the longitudinal slots or opposite the angular slots directly to the guide wall matched to the contour of the catch socket. For this reason deformation of the socket is no longer possible. In addition, the catch sleeve with catch lug or the lug alone presents a relatively large pressure area, by means of which impacts are distributed to such a large area that deformations are avoided. These advantages are also realized in that even in the locking position the sleeveshaped locking element is completely in the guide. Since in addition the locking element can only be moved over a short distance, or only turned about its axis, space is saved parallel to the canopy shaft. The relatively large force transmission area also permits small dimensioning of the interacting parts; the construction requires a small amount of space and the overall diameter can be kept small.

BRIEF DESCRIPTION OF THE DRAWINGS

Further objects of this invention will become apparent in the following description and drawings in which.

FIGS. **8*a*–8*c* are further views of modified forms of the examples shown in FIGS. 1A to 3.

Figure 9A:
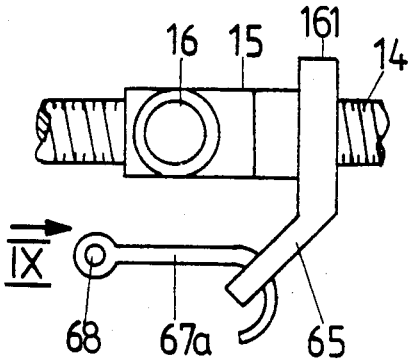
Figure 9B:
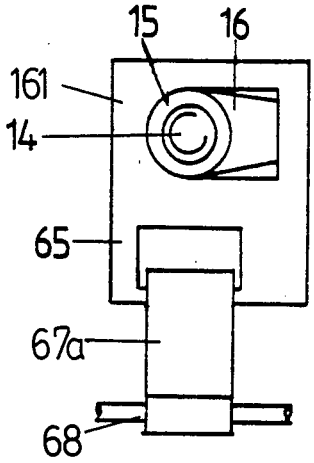
Figure 10A:
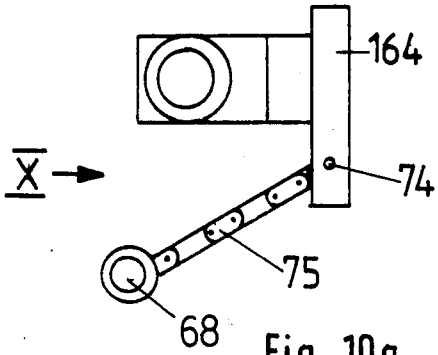
Figure 10B:
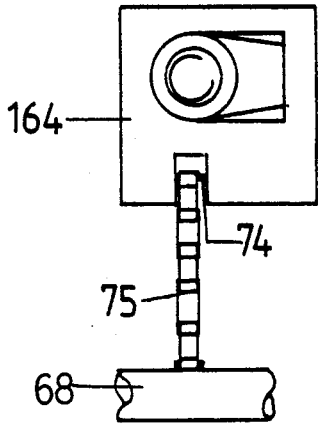

FIGS. 9*a*,9*b* are elevations of an embodiment of the device for limiting the axial adjustment movement of the catch lug with a catch sleeve, as well as a view in the direction of arrow IX in FIG. 9*a*; and FIGS. 10*a* and 10*b* are views showing further embodiments of the parts according to FIGS. 9*a*, 9*b* in the respective views.

DETAILED DESCRIPTION OF EMBODIMENTS OF THE INVENTION

Figure 1:
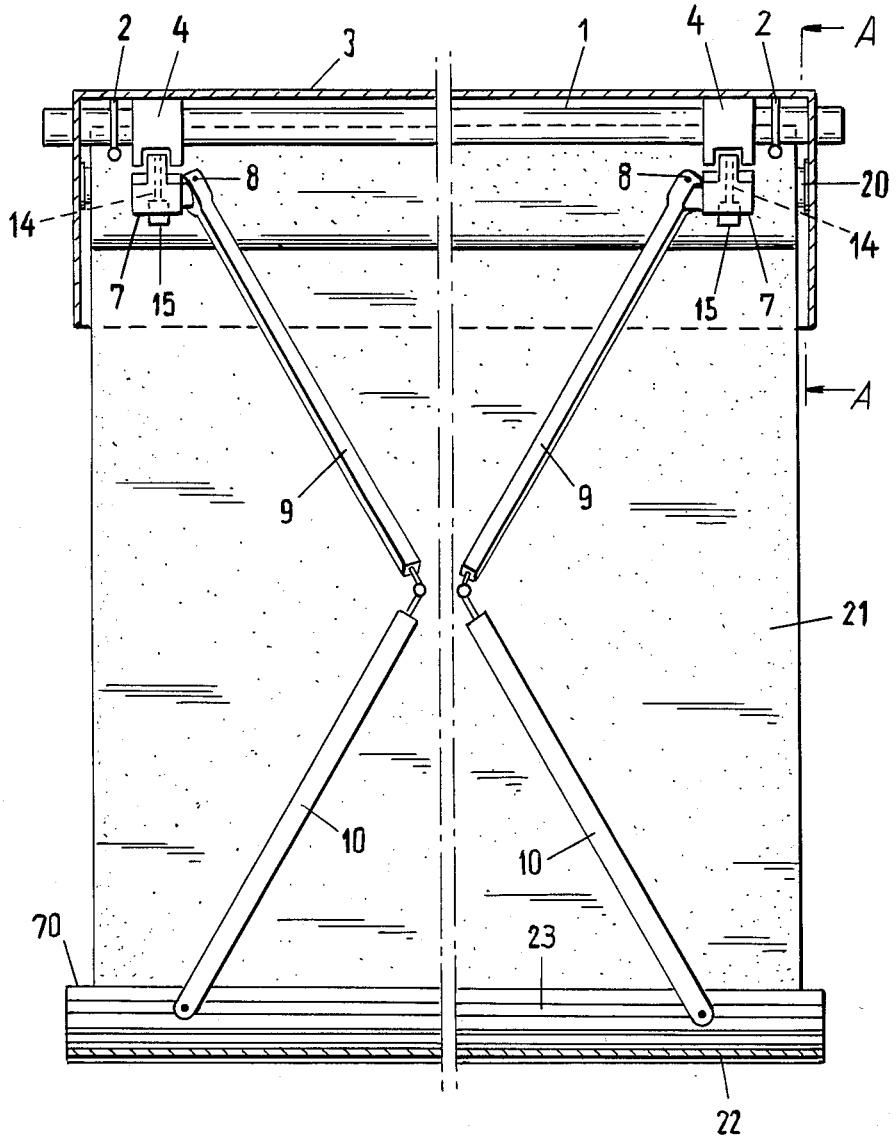
FIG. 1 is a view of an awning corresponding to FIGS. 1A–3, as seen from below, with the lower portions of the case 3 cut away.
Figure 1A:
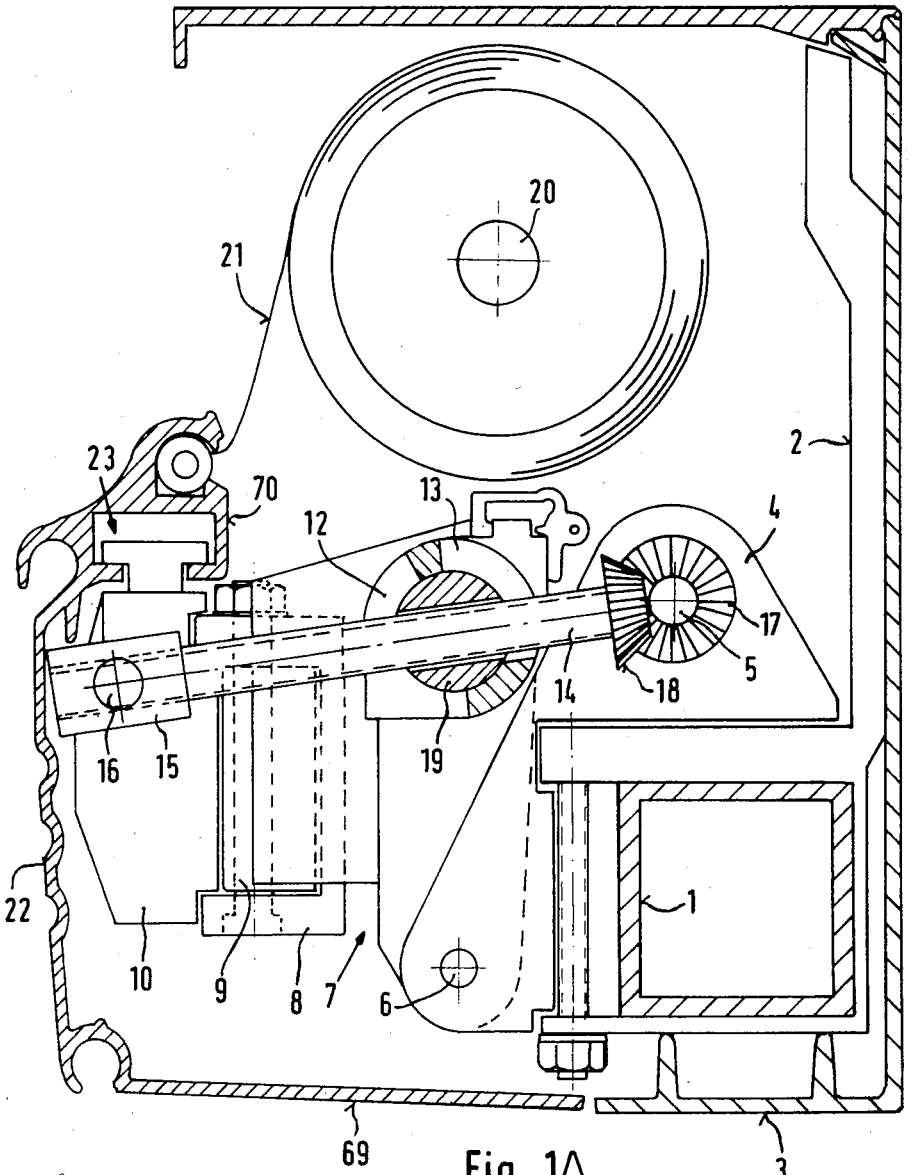
FIG. 1A is a view in cross section of an awning taken along line A—A of FIG. 1, rolled up and the side of the support structure removed.
Figure 2:
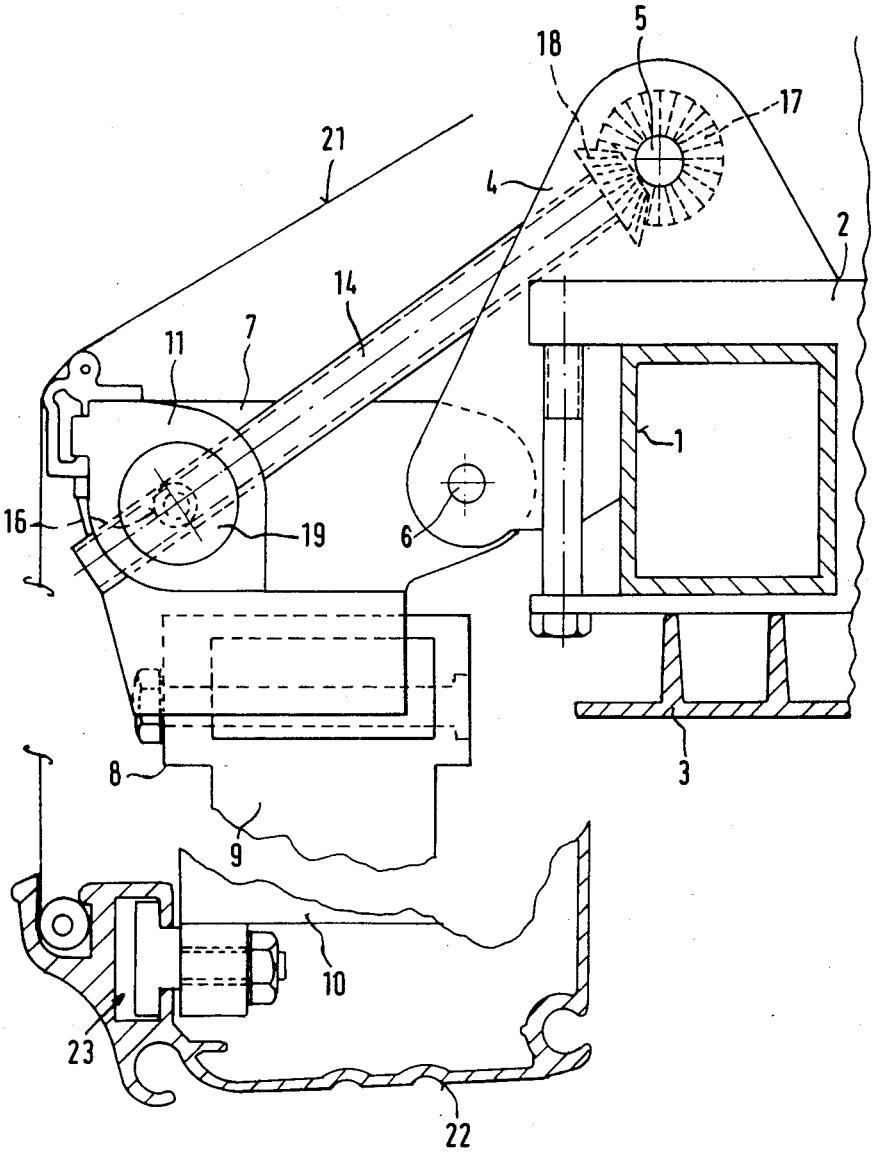
FIG. 2 is a view corresponding to FIG. 1 with the jointed arms 9–10 tilted 90° and extended.
Figure 3:
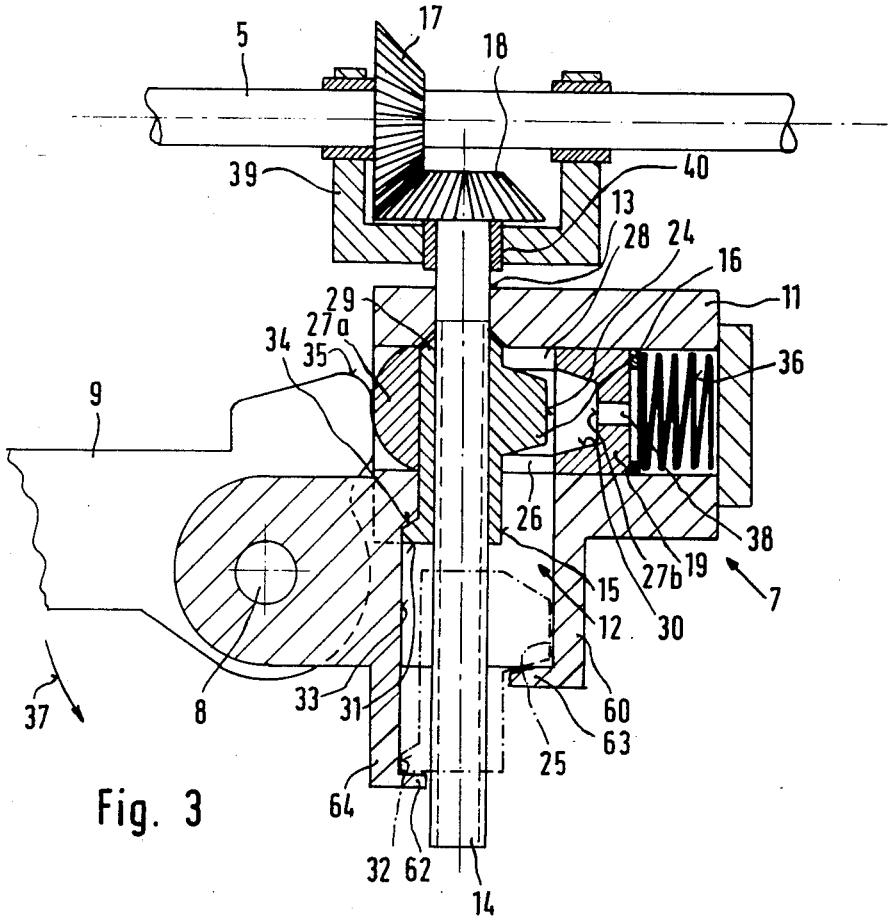
FIG. 3 is a plan view of a portion of a jointed arm 9–10 in a position corresponding to FIG. 1A, partially in cross section.

A first example of an embodiment of an awning according to the present invention is shown in FIGS. 1A to 3. A supporting tube 1 is fastened by mounting brackets 2 to a wall of a building or the like, which supports a case 3. By means of brackets (not shown) the supporting tube 1 supports a canopy shaft 20 for an awning canopy 21 arranged above said supporting tube. In addition, bearing brackets 4, one for each jointed arm, are fastened on the supporting tube. In the lower area of every bearing bracket 4 a bearing pin 6 for a hinged bearing support 7 is provided. As shown in FIG. 3 at the side the bearing support 7 has a pivoting joint 8 for the upper arm 9 of the associated two-member jointed arm 9–10. The upper and lower arms 9, 10 of every jointed arm, 9–10 are connected together by means of a flexing joint. A spanning profile 22 is attached to the free end of each of the lower arms 10 by means of a joint 23 and is fastened to the end of the canopy 21.

Figure 7:
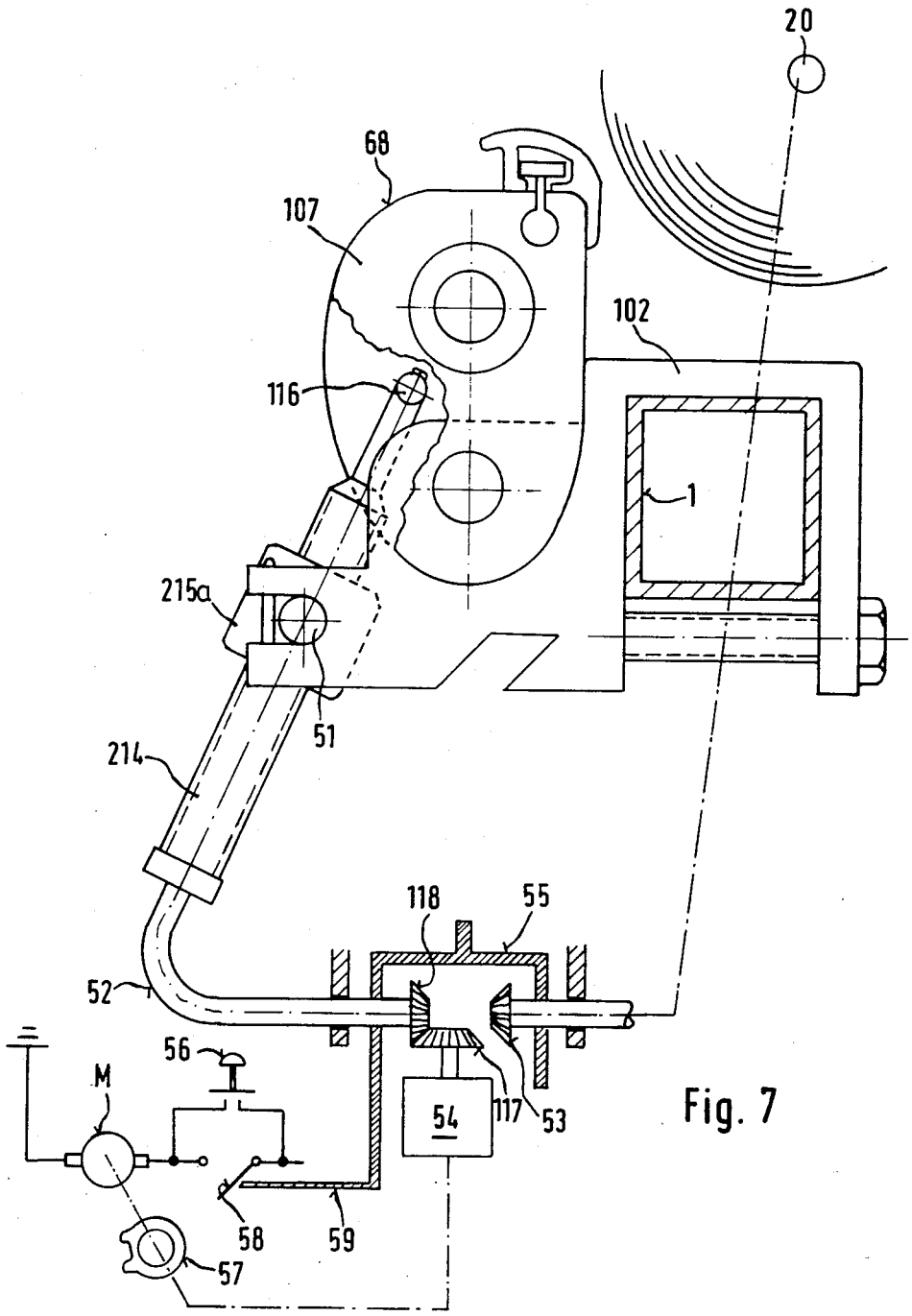
FIG. 7 is a cross-sectional view of a modified embodiment of the example shown in FIG. 4.

When the canopy 21 is being unrolled from the canopy shaft 20 the bearing supports 7 first hinge downward around their bearing pins 6 along a defined tilting angle under the influence of their own dead weight, and of that of the jointed arms 9–10 with spanning profile 22. This can be seen by a comparison of FIG. 1 with FIG. 2. Members 8, 9 and 10, as will be seen from FIG. 7 are connected to the supports 7. Then the retracted jointed arms 9–10 start to extend, which can be supported in a known manner by springs or the like between the upper and lower arms 9, 10 of every jointed arm 9–10.

The tilting angle can be set or adjusted by means of an adjustable and readjustable tilt limiter as part of each bearing support 7. Every tilt limiter has a guide 11 with two peripheral slots 12, 13 arranged at the top on the bearing support 7, through which slidably passes a screw bolt 14 mounted to be rotationally movable adjacent the upper area of the bearing bracket 4, but secured against axial movement. A catch sleeve 15 with catch lug 16 is screwed on the screw bolt 14 from the opposite end. This catch sleeve 15 with inside thread can be moved longitudinally on bearing support 7, but not rotationally. For this purpose the flat end surface 24 of the catch lug 16 abuts slidably against a countersurface 25 on a leg 60 of bearing support 7. (See FIG. 3, lower right section). In addition, on the side of the catch sleeve 15 facing away from the catch lug 16 a projection 31 facing outward can be provided which even with the bearing support 7 hinged down remains outside the guide 11. The end surface 32 of the projection 31 which is also flat interacts with a countersurface 33 on the bearing support 7, or more specifically on leg 64. (FIG. 3—opposite bolt 14 from leg 60 and below leg 60). A limit stop 63 on leg 60 and/or a limit stop 62 on leg 64 prevents the catch sleeve 15 from being screwed off the screw bolt 14. Variations of the catch sleeve/catch lug arrangements and of the limit stop which prevents the catch sleeve from screwing off are shown in FIG. 9*a*, 9*b* and 10*a*, 10*b*. These variations are described below in connection with the explanations to FIGS. 8*b* and 8*c*.

For setting or adjusting the tilt angle an operable adjusting shaft 5 is mounted to be rotatable at the top of the bearing bracket 4, a bevel gearwheel 17 being fitted rigidly on the end of the adjusting shaft 5 which meshes with a bevel gear 18 fixed on the upper end of the screw bolt 14. If the adjusting shaft 5 is turned, depending on the direction of rotation, the non-rotatably held catch sleeve 15 is moved either toward or away from the guide 11, whereby the tilt angle is changed. When the bearing support 7 hinges downward its guide 11 moves out of its starting position as shown in FIG. 1A on the shaft of the screw bolt 14 (which is pivoted as discussed below) until as shown in FIG. 2 the catch sleeve 15 and/or its catch lug 16 abuts directly or indirectly against the inner wall in the guide 11.

The screw bolt 14 is mounted on the bearing bracket 4 by means of a central bore 40 in a web portion of a pivoting bracket 39, which also has legs which have further bores 40 for the passage of the adjusting shaft 5 (see FIG. 3), the legs being in turn rotatably mounted in the bearing bracket 4. The screw bolt can also be mounted in other suitable ways.

In addition, the awning has a wind lock which interacts with the catch sleeve 15 or its catch lug 16 to prevent the extended canopy 21, and hence the jointed arms 9–10 as well, from flying up. This wind lock includes a catch socket 19 which can be moved rotationally in the cylindrical cavity of the guide 11, two radially opposed longitudinal slots 26, 28 being provided in the catch sleeve 15 for the passage of the screw bolt 14. The width of at least the longitudinal slot 26 is matched to the diameter of the catch sleeve 15. On the end the catch socket 19 is closed off by end pieces 27*a*, 27*b*. By virtue of the end pieces on both sides (27*a*, 27*b*) the longitudinal slots 26, 28 are closed at both ends, so that the catch socket 19 has good stability.

In continuation of the longitudinal slots 26, 28 a socket opening 30 matched to the shape of the catch lug 16, which is aligned parallel to the slots 26, 28, is provided in the end piece 27*b*. To facilitate snapping in of the catch lug 16 into the socket opening 30, these two parts are of conical shape.

If required, two catch lugs 16 facing in opposite directions can protrude from the catch sleeve 15, in which case however either the catch socket 19 must be correspondingly longer, or the two catch lugs 16 of the length of the slot 26 must be correspondingly shorter.

The catch socket 19 is tensioned by a compression spring 36 arranged in the guide 11 at the right (FIG. 3) next to the end piece 27*b* such that the spring can force the catch socket 19 to the left. The space accommodating the compression spring is vented e.g. via a vent opening 38. The venting can also be accomplished in any other manner. An actuating cam 35 is located on the upper arm 9 which interacts with the end piece 27*a*.

Figure 8A:
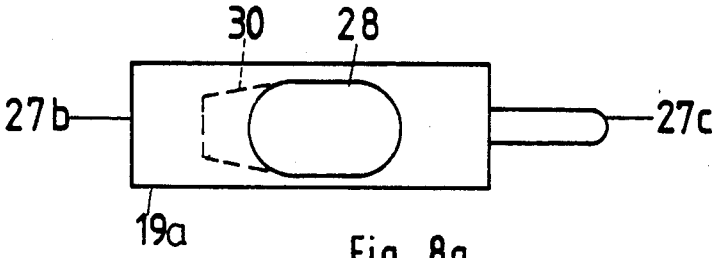
FIG. 8*a* shows a plan view of the slot opening of a catch socket.

FIG. 8*a* shows a modified catch socket 19*a*, on which a finger 27*c* is provided in place of a rounded end area 27*a* which is depressed by the cam 35 (FIG. 3). Such a construction would be selected when the providing joint 8 is more remote from the socket 19*a* than in FIGS. 1–3. It can moreover be seen that the representation of FIG. 8*a* is rotated 180° with respect to that of FIG. 3, so that the socket opening 30 is on the left side of the illustration in FIG. 8*a*.

With a retracted awning as shown in FIG. 1, as a result of the folded position of the jointed arm 9–10 the actuating arm 35 forces the catch socket 19 to the right against the acting of the compression spring 36 into the position as shown in FIG. 3, so that the socket opening 30 releases the catch lug 16. If the canopy shaft 20 is now rotated in the unrolling sense, the bearing support 7 starts—as already mentioned—to tilt downward until the catch sleeve 15 and/or its catch lug 16 support themselves against the inner wall of the guide 11 and/or the inner portion of the catch socket 19. In the initial stage of the extension process of the jointed arm 9–10 the upper arm 9 pivots about the pivoting joint 8, whereby actuating cam 35 also departs from end piece 27*a*, so that under the action of the compression spring 36 the catch socket 19 moves to the left. In the course of this sliding movement the catch lug 16 is accommodated by the socket opening 30 of the catch socket 19, whereby the catch sleeve 15 is held fast. A gust of wind acting on the extended canopy 21 can therefore not force the bearing support 7 upward via the jointed arm 9–10 because the catch lug 16 is in engagement with the catch socket and thereby prevents the guide 11 from sliding on the screw bolt 14.

To ease slipping of the socket opening 30 over the catch lug 16, these two parts can also be centered by the catch sleeve 15 having a short extension 29 from the catch lug 16 on the side facing the guide 11, said extension engaging in the inner wall of the guide 11 to perform a support function when the bearing support 7 is hinged down. A conical shape of these two parts then effects a centering of the catch lug 16 with the socket opening 30. But the projection 31 can also contribute to the centering of the aforementioned parts if in the bearing support 7 a beleveled surface 34 has guide surfaces for the projection 31 enlarging conically to the outside.

Figure 6:
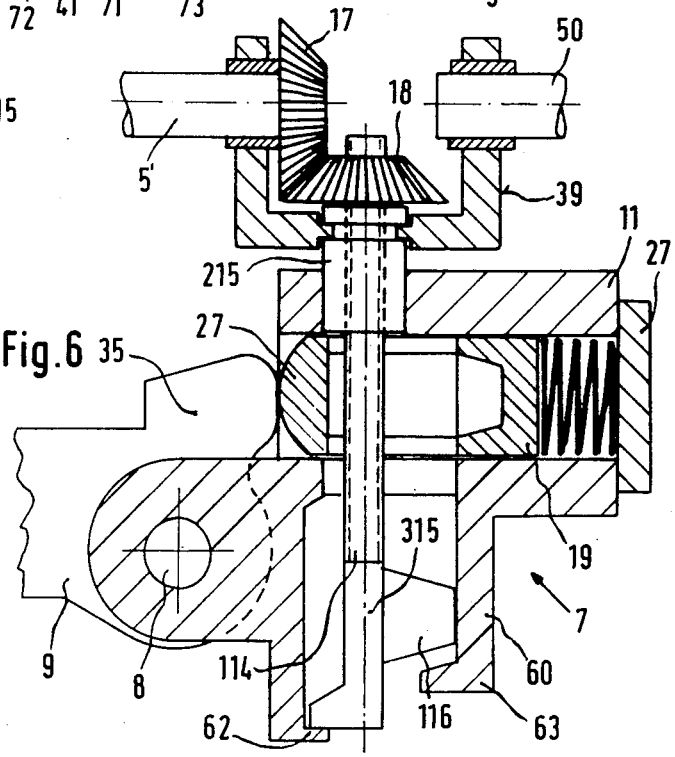
FIG. 6 is a plan view of the inner joint area of a further modified embodiment of an awning similar to FIG. 3.

FIG. 6 shows a modification of the example according to FIGS. 1 to 3, the difference consisting in the bevel gear 18 being connected with a threaded sleeve 215 which is rotatable but which cannot be moved longitudinally in bracket 39. The catch lug 116 is arranged on the free end 315 of the screw bolt 114 facing away from the guide 11. This end performs the function of the catch sleeve 15 as demonstrated in FIGS. 1 to 3. Hence, the screw bolt 114 is adjusted by the threaded sleeve 215.

As can be seen, the drive shaft 5' ends at the bevel gearwheel 17, the pivoting bracket 39 must therefore be hinged to an axle 50, in order to allow the screw 114 to pass between the ends of the shaft 5' and the axle 50. This may be considered to be a disadvantage if for design reasons the shaft is to be of through construction. In this case it is therefore advisable for a worm gearing (not shown) to be provided in place of a bevel gearing, the worm (not shown) being carried by the through shaft, and the worm gear (not shown) by the threaded sleeve 215. In this case the drive shaft would be displaced away from the area of the central axis of the drive wheel (worm gear) for the threaded sleeve 215, and hence out of the area of the projecting screw bolt 114. In this case a bracket or support structure corresponding to the pivoting bracket 39 has the function of securing, so that here as well the threaded sleeve 215 can still only rotate around the geometrical axis of the shaft, assuring meshing of the worm gear at all times.

The advantage of the solution of FIG. 6 is that with the same strength and stability it is possible for the parts 116, 19 und 11 to have a smaller diameter, which has a favorable effect on the weight of the entire structure.

Figure 4:
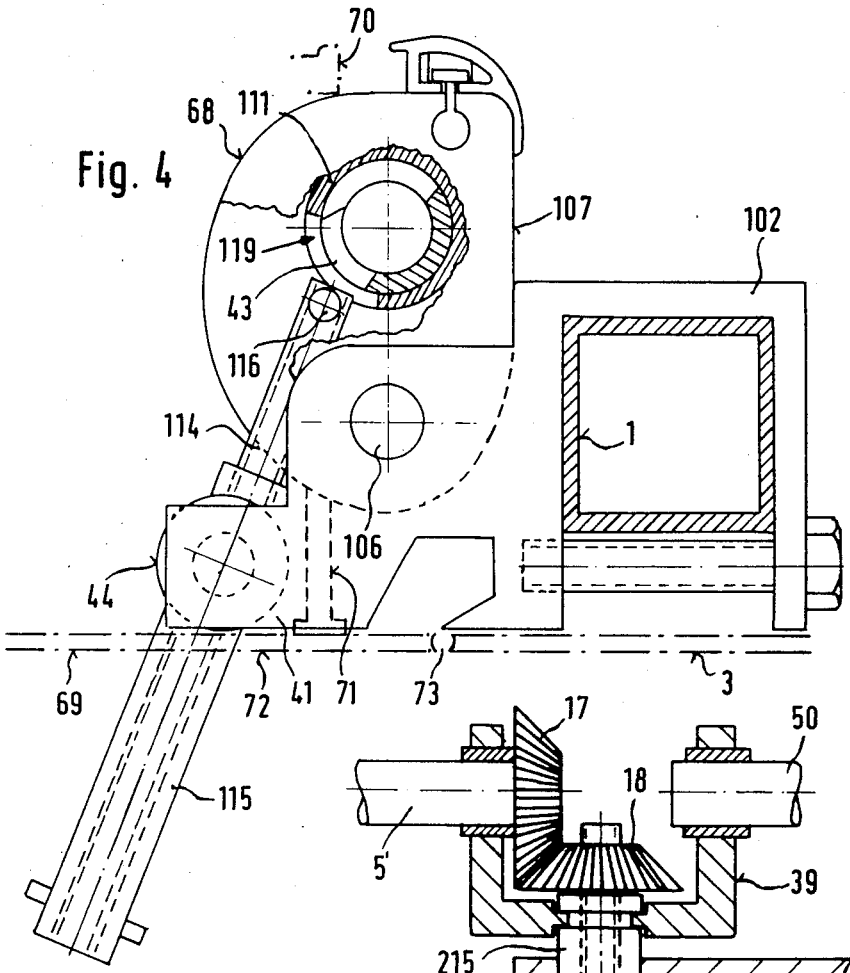
FIG. 4 is a cross sectional view in the inner joint area of a further embodiment of an awning.
Figure 5:
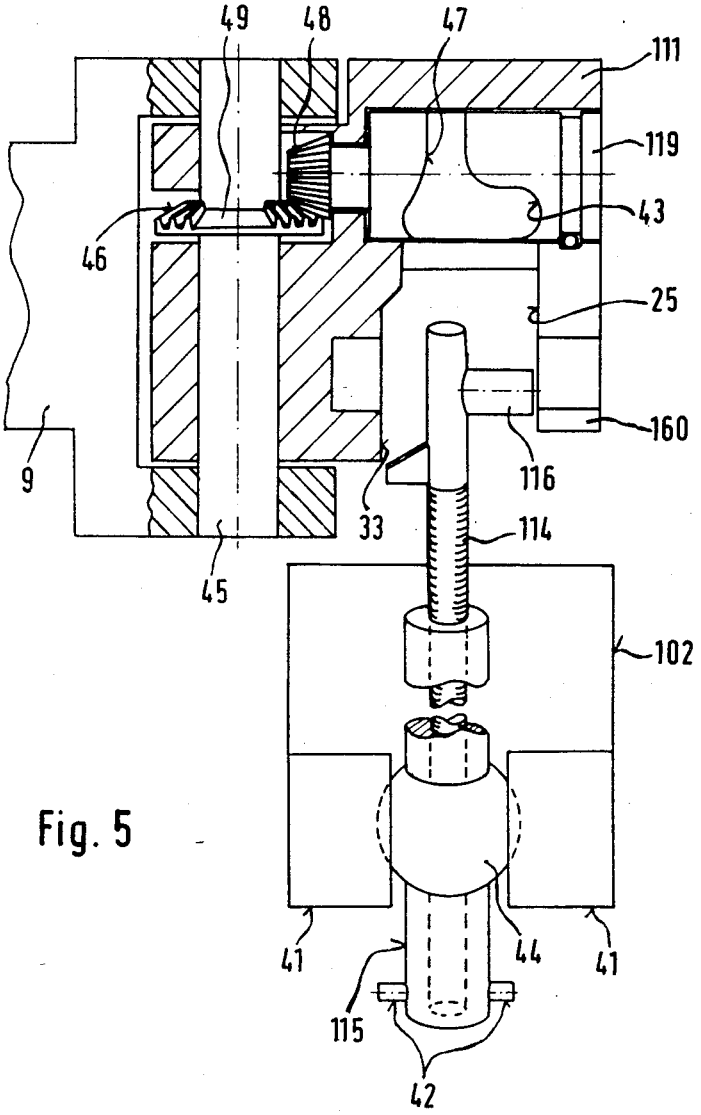
FIG. 5 is a plan view of the inner joint area as shown in FIG. 4, partially in cross section.

With the embodiment of the awning according to FIGS. 4 and 5 in place of the bearing bracket 4 in the embodiment of FIGS. 1–3 a mounting bracket 102 is fastened on the supporting tube 1 which at hinge joint 106 carries the bearing support 107, the guide of which 111 accepts a catch socket 119 merely rotatably. The screw bolt 114 is, to be sure, mounted rotatably in a threaded sleeve 115, but secured against turning by the side wall of the support bracket 160.

The threaded sleeve 115 is held pivotably movable, as well as rotationally movable, on an extension of the mounting bracket 102 with the aid of a universal joint or the like. In the example as shown in FIG. 5 this joint is formed by a spherical thickening 44 of the threaded sleeve 115 which engages in spherical depressions in a fork-shaped extension 41 on the mounting bracket 102. It is important for the threaded sleeve 115 to be seated rotatably, but secured against axial movement and pivotable in a bearing formed by the spherical thickening 44 and the spherical depressions in the extension 41 of the mounting bracket 102 around an axis parallel to the support tube 1.

The end area of the screw bolt 114 facing the guide 111 projects freely upward. With the bearing support 107 hinged back the screw bolt 114 is supported on the mounting bracket 102, such that its end facing the guide 111 is held in the area of the path of pivot travel of the catch socket 119. In place of this support a spring can also be provided which holds the screw bolt 114 in the area of the path of pivot of the catch socket 119.

On the end which is consequently free the screw bolt 114 carries catch lug 116 which here has a cylindrical cross section. The tilt angle is consequently limited merely by the pivoting bearing support 107 with its guide 111 and/or its catch socket 119 striking and resting against the catch lug 116. The pivot angle is changed by turning the threaded sleeve 115, so that the shaft area of the screw bolt 114 projecting out of the threaded sleeve 115 with catch lug 116 projects to a greater or lesser extent.

The catch socket 119 has an angled slot, one leg 47 of which in cross-sectional form extends in the transverse direction, the other leg 43 of which extending in the longitudinal direction. The leg 43 serves to accept the catch lug 116 and the end of the screw bolt 114 in the cavity of the catch socket 119. Here, actuation of the catch socket 119 causes a ring gear 46, which is connected rotationally rigid with a journal pin 45, said journal pin being connected rotationally rigid with the upper arm 9, to rotate as well, said ring gear 46 meshing with a bevel gear 48 arranged nonrotationally on the front end of the catch socket 119.

With the awning retracted the longitudinal leg 43 of the angled slot faces the end of the screw bolt 114 with catch lug 116. When the bearing support 107 hinges down the guide 111 with its catch socket 119 overreaches the end of the bolt after it and its catch lug 116 have passed the longitudinal leg 43 of the slot. As soon as the hinging bearing support 107 rests against the end of the bolt, the jointed arm 9–10 starts to extend. Via its journal pin 45 the extending upper arm 9 rotates the ring gear 46 such that, via a bevel gear 48, the catch socket 119 is turned so that the bar shaft enters the transverse leg 47 of the angled slot, and the catch lug 116 leaves the longitudinal leg 43. Since the catch lug 116 can now no longer escape from the catch socket 119, the bearing support 107 is secured against lifting.

The transverse leg 47 of the slot extends over a length analogous to the maximum sweep of the upper arm over a range of about 90°. The transverse leg 47 can also be shorter, which increases the stability of the catch socket 119 if the ring gear 46 is toothed only segmentally, thereby producing an untoothed part 49. When the upper arm 9 is extended the bevel gear 48 will only rotate until the untoothed part 49 is reached, at which point it will stop. The toothed area of the ring gear 46 is only long enough so that the catch socket 119 is turned only so far that the catch lug 116 can not escape. In this context the gears 46, 48 can be designed so as to provide for a transmission ratio over the toothed area, so that the wind lock already comes into effect shortly after the extension procedure starts.

In FIG. 7 a modification of the embodiment according to FIGS. 4 and 5 is shown. Here as well the screw bolt 214 has a catch lug 116. Here, two opposing cath lugs also constitute an expedient configuration. However, the screw bolt 214 is held rotatably in a nut 215*a* which is mounted pivotably on the mounting bracket 102, by means of a trunnion 51. When the tilting range is being set and adjusted the catch lug 116 rotates along with the screw bolt 214.

It would be possible to employ a ball which is axially fixed with respect to the screw bolt 214 rather than the catch lug 116, but it is preferred to retain the advantages of the catch lug 116. When setting or adjusting the tilt angle by rotating the screw bilt 214, the catch lug 116 must go into the correct position in order to be able to enter the wind lock. This condition is fulfilled in that with only one catch lug 116 it is only possible to turn the screw bolt 214 over one or more whole 360° ranges, while with two trunnions over 180° ranges is possible. This can easily be accomplished with the aid of an electric motor, the lower end of the screw bolt 214 being connected to a flexible shaft 52, and the other end carrying a bevel gearwheel 118. This gearwheel 118 is mounted axially movable, as is an opposing bevel gear 53, which has an operating connection with the canopy shaft 20 as indicated schematically in FIG. 7. A drive bevel gearwheel 117 at the output end of a reduction gearing 54 interacts alternatingly with the one or the other bevel gear 118 or 53. For this purpose a schematically indicated gear shift mechanism 55 is provided, which can be engaged in each of its positions in a manner not shown.

A drive motor M can be turned on by briefly depressing a switch 56. Along with the motor M a cam 57, a contact disc or the like also turns, which closes an N/O selfholding contact 58, consequently supplying the motor M with current until the screw bolt 214 has rotated 360° (or 180°). Only then does the cam 57 release the contact 58 again.

This naturally means that from now on adjustment of the tilting movement is only possible in steps, which however with a correspondingly fine thread on bolt 214 does not involve a substantial difference from an infinite adjustment. If the self-holding action of the contact 58 for the drive of the canopy shaft 20 is not desired, the gear shift mechanism 55 can be furnished with an extension 59, which when the gear shift mechanism 55 is moved to the left holds the contact 58 closed. The canopy shaft 20 is now driven as long as the switch 56 is held closed.

For the drive of the canopy shaft or of the screw bolt different speeds are expediently selected, which can be accomplished either by at least one of the bevel gears being connected with a corresponding gearing, or by shifting of the gearing 54 with the shift mechanism 55 for changing the transmission ratio similar to an automotive shift transmission. Finally, it is also conceivable that due to the shift mechanism the motor speed itself is controlled, say by a resistor in the motor current circuit being connected or disconnected. It is also understandable that the alternative coupling of bevel gears 118 or 53 can also be realized with a manual drive system. The shifting can be also be accomplished in that a differential gearing is provided, the two outputs of which are alternatively braked.

Figure 8B:
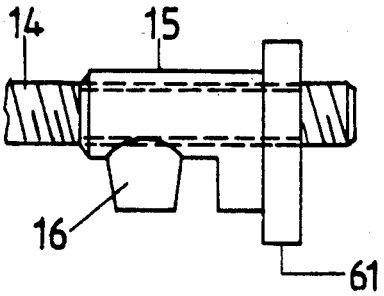
FIG. 8*b* shows a modification of the catch sleeve and FIG. 8*c*** shows a modification of the part of the tilting limiter with catch socket.
Figure 8C:
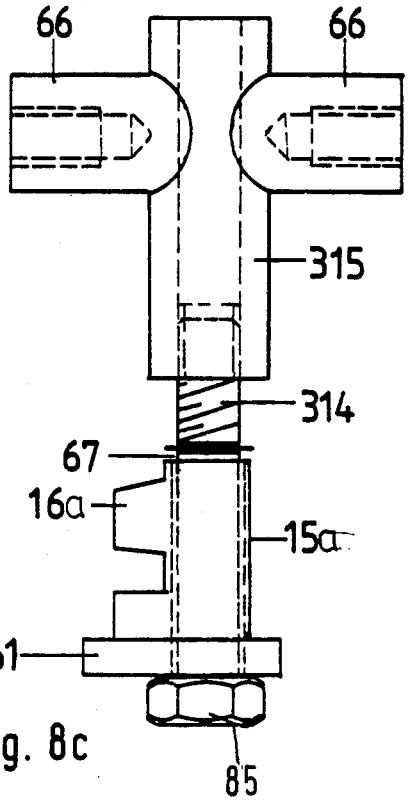

With the examples according to FIGS. 1 to 6 the catch lug 16 or 116 can serve as a rotation lock alone. For this purpose however a separate end plate 61 can be used as shown in FIGS. 8*b* and 8*c*, it being possible for the end plate 61 to interact with a limit stop analogous to the limit stops 62, 63. Instead of the jaw extensions, fork-shaped extensions can also be provided, the prongs of which overreach the catch lug 16 or 116 above and below.

With a simplified construction for setting and adjusting the stop, the bevel wheel gearing as shown in FIG. 3 can be omitted, and a hex head 85 on the screw bolt 314 can be used in the known manner as shown in FIG. 8*c*, by means of which the screw bolt 314 can be screwed in a threaded sleeve 315 to alter the distance, said sleeve then being mounted pivotably by means of bearing projections 66 on bearing support 7 instead of in a pivoting bracket (FIG. 6). In place of the hex head, transverse pins (see FIG. 5) or a motor analogous to FIG. 7 can be provided as a means of acutation. In this instance the thread area of the screw bolt 314 can as shown be relatively short, is on its lower area a threadless section 67 for a catch sleeve 15*a*, which here is also threadless, with a catch lug 16*a* is foreseen, said catch sleeve 15*a* being mounted freely rotatable on the bolt 314 and unmovable relative to the bearing support 7. As a turning lock the catch sleeve 15*a* can be fitted with the end plate 61, which interacts with the extensions 60, 64 (FIG. 3).

As shown by FIGS. 4, 5 and 7 under certain circumstances the jaw or fork extensions serving as part of the turning lock can have a very long outreach, thereby impairing the compactness of the design. To reduce the horizontal outreach of the retraced awning, instead of providing the lock against turning and inadvertent screwing down of the catch sleeve 15, as shown in FIGS. 7*a*, 9*b*, an end plate 161 with an extension 65 facing the bearing support 7 can be provided, the end plate 161 being engaged by a hook 67*a* mounted on a stationary axle 68. This hook 67*a* prevents the screw bolt 14 from screwing out too far. The hook 67*a* and the axle 68 can be arranged at a location where space is available, e.g. above the retracted upper arm 9, so that space is saved on the front side.

According to FIGS. 10*a* and 10*b* a chain 75 can be fastened to an end plate 164 via a pin 74, whereby an even less bulky lock against turning and unscrewing than the one previously described is devised to provide a turning lock. In addition to the movement limitation, the corresponding chains must be of themselves unturnable, as is the case with a plate link chain, the roller and inverted tooth chain, as well as link chains, e.g. the Vaicanson hook chain.

What I claim is:

1. An awning comprising:

an awning and a support therefor;

an awning shaft rotatably supported by said support in a substantially horizontal position; means for rotating said shaft;

an awning web having an inner end thereof secured to said awning shaft; said awning web having an outer end opposite said inner web; said awning web being capable of being unwound from said awning shaft with its outer end first;

bearing support means hinged on said support and adapted to be tilted about a tilt axis substantially parallel to said awning shaft;

a front bar for serving as a stretcher bar for said outer end of said awning web;

an articulated arm having an inner end and an outer end; outer joint means pivotally interconnecting said outer end of said articulated arm and said front bar;

inner joint means pivotally interconnecting said inner end of said articulated arm and said bearing support means;

tilt-down limiting means for limiting the tilting movement of said bearing support means occurring when said awning web begins to be unwound, said tilt-down limiting means including screw bolt means having a longitudinal axis and being pivotally mounted on said support about a pivoting axis parallel to said tilt axis, adjustable abutment means on said screw bolt means, and counter-abutment means on said bearing support means for being abutted by said abutment means;

tilt-up catching means including socket means having a peripheral wall and being movable between a locking position and a releasing position, slot means in said peripheral wall arranged to embrace said screw bolt means at least in said locking position, guide means on said bearing support means for guiding the movement of said socket means, and drive means connected with said articulated arm to provide a synchronized movement of said socket means;

said abutment means comprising lug means extending substantially normally to said screw bolt means, in the locking position of said socket means, said lug means being embraced by said socket means.

2. An awning construction as claimed in claim 1, further comprising internal threaded sleeve means screwed onto said screw bolt means for adjusting the position of said abutment means, said socket means being rotatably and shiftably guided by said guide means to be shifted in a direction parallel to said tilt axis, said slot means comprising two slots being radially opposite in said peripheral wall to enable said screw bolt means to pass through, said slots extending over part of the length of said socket means parallel to the moving direction of the same.

3. An awning construction as claimed in claim 2, wherein said lug means are secured to said screw bolt means, the sleeve means being pivoted on said support means.

4. An awning construction as claimed in claim 2, wherein said lug means are secured to said sleeve means, at least one of said slots being dimensioned to receive said sleeve means.

5. An awning construction as claimed in claim 4, wherein said screw bolt means are supported rotatably about their longitudinal axis, said guide means comprising slot means for enabling said screw bolt means to pass through, and said sleeve means being arranged on the free end of the screw bolt means, which protrude through said guide means, said sleeve means including rotation preventing means.

6. An awning construction as claimed in claim 5, wherein said rotation preventing means comprise a front surface on said lug means, and a sliding surface on said bearing support means for engaging said front surface, said sliding surface extending along the path of relative movement of the lug means and the bearing support means during the tilting movement of the latter.

7. An awning construction as claimed in claim 5, wherein said rotation preventing means comprise projection means on said sleeve means angularly offset relative to said lug means, said bearing support means comprising counter-surface means for engaging said projection means.

8. An awning construction as claimed in claim 5, wherein said rotation preventing means comprise an extension arranged on said sleeve means, and retaining means pivotally but unrotatably connected to said support means, said retaining means engaging said shoulder means.

9. An awning construction as claimed in claim 8, wherein said retaining means comprise hook means.

10. An awning construction as claimed in claim 8, wherein said retaining means comprise distortion-stiff chain means.

11. An awning construction as claimed in claim 8, wherein said shoulder means comprise a recess to be engaged by said retaining means.

12. An awning construction as claimed in claim 2, wherein said lug means comprise a lug of frusto-conical shape.

13. An awning construction as claimed in claim 12, wherein said socket means comprise an internal opening shaped for receiving said frusto-conical lug means, said opening extending in axial direction from the end of said slots.

14. An awning construction as claimed in claim 2, further comprising biasing means for biasing said socket means towards one of their positions, said drive means moving said socket means against the force of said biasing means.

15. An awning construction as claimed in claim 14, wherein said socket means are biased towards the locking position, said drive means comprising protruding means on said articulate arm means, said protruding means engaging said socket means.

16. An awning construction as claimed in claim 15, wherein said socket means protrude at least in said releasing position from said guide means on the side facing said inner joint means.

17. An awning construction as claimed in claim 14, wherein said biasing means comprise a pressure spring interposed between said socket means and the end of said guide means.

18. An awning construction as claimed in claim 1, wherein said socket means are closed on their front ends.

19. An awning construction as claimed in claim 2, further comprising adjusting shaft means for adjusting the position of said abutment means, said adjusting shaft means being supported in parallel relationship to said awning shaft by said support means; and adjusting drive means operationally connecting said adjusting shaft means and said rotatable screw bolt means at that end of the latter which faces said pivoting axis.

20. An awning construction as claimed in claim 19, further comprising bracket means rotatably bearing said screw bolt means and being pivotally supported by said adjusting shaft means which from said pivoting axis of said screw bolt means.

21. An awning construction as claimed in claim 19, wherein said adjusting drive means comprise gear means.

22. An awning construction as claimed in claim 21, wherein said gear means comprise a first bevel gear secured to said adjusting shaft means, and a second bevel gear connected with one end of said screw bolt means.

23. An awning construction as claimed in claim 22, wherein said second bevel gear is directly secured on one end of said screw bolt means which faces said adjusting shaft means.

24. An awning construction as claimed in claim 22, further comprising bracket means pivotally supported by said adjusting shaft means which from said pivoting axis of said screw bolt means; and rotation preventing means for said screw bolt means; said second bevel gear being secured to said sleeve means rotatably supported by said bracket means, but being secured against axial displacement; said lug means being secured to the other end of said screw bolt means.

25. An awning comprising:

an awning and a support therefor;

an awning shaft rotatably supported by said support in a substantially horizontal position; means for rotating said shaft;

an awning web having an inner end thereof secured to said awning shaft; said awning web having an outer end opposite said inner web; said awning web being capable of being unwound from said awning shaft with its outer end first;

bearing support means hinged on said support and adapted to be tilted about a tilt axis substantially parallel to said awning shaft;

a front bar for serving as a stretcher bar for said outer end of said awning web;

an articulated arm having an inner end and an outer end; outer joint means pivotally interconnecting said outer end of said articulated arm and said front bar;

inner joint means pivotally interconnecting said inner end of said articulated arm and said bearing support means; and means for limiting the tilting movement of said bearing support means on initiation of the unwinding movement of said awning web.

26. An awning construction as claimed in claim 2, wherein said socket means are rotatably guided by said guide means, said slot means having two sections, a first section of them extending in axial direction of said socket means and being dimensioned to from a passage for one end of said screw bolt means bearing said lug means which protrude on one side of the screw bolt means, a second section of them extending in peripheral direction of said socket means and having a width small enough to allow only the screwbolt means to pass through, while the lug means are catched within said socket means.

27. An awning construction as claimed in claim 26, further comprising internally threaded sleeve means screwed onto said screw bolt means for adjusting the position of said abutment means, said sleeve means being movably supported by said support means; and rotation preventing means for said screw bolt means.

28. An awning construction as claimed in claim 27, wherein said rotation preventing means comprise projection means on said screw bolt means within the range of the one end of the same, and counter-surface means on said bearing support means for engaging said projection means.

* * * * *